United States Patent [19]

Woolley et al.

[11] Patent Number: 4,735,062

[45] Date of Patent: Apr. 5, 1988

[54] REFRIGERATOR WITH ANTI-SWEAT HOT LIQUID LOOP

[75] Inventors: Samuel J. Woolley; Donald S. Cushing; Thomas E. Jenkins; Keith W. Gerdes; Robert R. Sisler, all of Louisville, Ky.

[73] Assignee: General Electric Company, Louisville, Ky.

[21] Appl. No.: 64,593

[22] Filed: Jun. 22, 1987

[51] Int. Cl.[4] ..... F25B 47/00

[52] U.S. Cl. ..... 62/277; 312/214; 312/296

[58] Field of Search ..... 62/81, 277; 312/296, 312/214

[56] References Cited

U.S. PATENT DOCUMENTS

| | | | |
|---|---|---|---|
| 2,280,133 | 4/1942 | Sundbach | 62/126 |
| 2,457,009 | 12/1948 | Tanner | 257/21 |
| 2,476,906 | 7/1949 | Philipp | 62/277 |
| 2,537,314 | 1/1951 | Mortensen | 62/277 |
| 2,612,351 | 9/1952 | Janos | 257/256 |
| 2,654,231 | 10/1953 | Eichhorn | 62/116 |
| 2,795,035 | 6/1957 | Kafer | 29/157.3 |
| 3,157,306 | 11/1964 | Courson | 312/296 X |
| 3,572,051 | 3/1971 | Benasutti | 62/277 |
| 3,835,660 | 9/1974 | Franck | 312/296 X |
| 3,984,223 | 10/1976 | Whistler, Jr. | 62/277 X |
| 4,076,076 | 2/1978 | Harrison | 165/171 |
| 4,158,294 | 6/1979 | Keeling, Jr. | 62/277 |
| 4,192,149 | 3/1980 | Webb | 62/277 X |
| 4,197,718 | 4/1980 | Abraham et al. | 62/277 X |

*Primary Examiner*—Lloyd L. King
*Attorney, Agent, or Firm*—Frederick P. Weidner; Radford M. Reams

[57] ABSTRACT

A cabinet assembly for a refrigerator having a freezer compartment on top, a fresh food compartment on the bottom and a hot liquid anti-sweat loop. The cabinet assembly outer sheet metal shell has a top panel, side panels and a front face with the front face formed to provide a first U-shaped portion which includes a first outer wall perpendicular to the side panel to form a corner and a second inner wall spaced from the first outer wall and both walls being connected by a first reverse bend portion. The second inner wall being reversely bent to form a third wall and provide a second U-shaped portion formed between the second inner wall and the third wall. The first, second and third walls being in spaced parallel planes and the third wall being bent at a right angle to form a flange having a free edge. Braces are located at both of the top front corners of the cabinet and these braces have two formed sections at right angles to each other and each section is formed as an inwardly open U-shaped channel having a base, a first leg and a second leg spaced apart and integrally joined to the base. The base is adjacent the rear surface of the third wall of the front face with the first leg parallel to and abutting the side panel of the cabinet and the second leg parallel to and abutting the flange of the front face. The second leg of the corner brace is fastened to the flange of the third wall of the front face and the hot liquid anti-sweat loop is secured to the braces.

11 Claims, 5 Drawing Sheets

REFRIGERATOR WITH ANTI-SWEAT HOT LIQUID LOOP

BACKGROUND OF THE INVENTION

This invention relates to household refrigerators and in particular to the cabinet assembly for a refrigerator having a freezer compartment on top, a fresh food compartment on the bottom, and incorporating a hot liquid anti-sweat loop.

It is common practice in the manufacture of household refrigerators to incorporate an anti-sweat heater in the front face of the freezer compartment which surrounds the access opening of that compartment and these heaters are either electric resistance heaters or a hot liquid tube heater which is part of the condenser unit of the refrigeration system. The refrigeration system of a household refrigerator includes a compressor, condenser and evaporator wherein refrigerant is compressed by the compressor to produce hot liquid which is pumped to the condenser. The liquid subsequently passes through the liquid line and a capillary tube to the evaporator where heat from inside the refrigerator is used to boil the liquid in the evaporator and the liquid is then returned to the compressor by the suction line. The condenser is an elongated tube that is formed in a serpentine and contains hot refrigerant liquid and a portion of the tube or loop may be used to perform the anti-sweat function in the refrigerator.

It is normal for refrigerators and particularly the freezer compartment of the refrigerators to have some small amount of cold air leakage and/or normal conduction through the gasket sealing the access door to the freezer compartment and that small amount of leakage can cause the front face to be cold. Condensation results around the face of the freezer compartment when warm humid room ambient air comes in contact with the cold surface. The anti-sweat heater is to warm the area around the front face of the freezer compartment so that condensation is minimized.

It has been the usual practice in installing the hot liquid loop in a refrigerator cabinet that it be secured in some manner usually by many metal or plastic clips. The manipulation of the rather long, small diameter tube forming the loop to place it correctly in the cabinet for good heat transfer characteristics is very difficult. This practice results in costly installation and due to the tolerances involved between the liquid loop and the cabinet in many instances the liquid loop is not retained tightly against the front face of the freezer compartment for maximum heat transfer.

By this invention there is provided an arrangement whereby the hot liquid anti-sweat loop from the condenser is secured to the cabinet and in good heat transfer relationship therewith with a minimum amount of clips or other securing means.

SUMMARY OF THE INVENTION

There is provided a cabinet assembly for a refrigerator having an outer metal shell with a top panel, side panels and a front face with a freezer compartment on top, a fresh food compartment on the bottom, and a mullion partition between the compartments. The cabinet assembly also includes a hot liquid anti-sweat loop from the condenser unit of the refrigeration system to transfer heat from the hot liquid loop to the front face on three sides of the freezer compartment. The front face is formed to provide a first U-shaped portion which includes a first outer wall perpendicular to the side panel to form a corner and a second inner wall spaced from the first outer wall, both walls being connected by a first reverse bend portion. The second inner wall is reversely bent to form a third wall and provide a second U-shaped portion formed between the second inner wall and the third wall. The first, second and third walls are in spaced parallel planes with the third wall bent at a right angle to form a flange having a free edge.

A brace is located at each of the two top front corners of the cabinet and these braces have two formed sections at right angles to each other and each section is formed as an inwardly open U-shaped channel having a base, a first leg and a second leg spaced apart and integrally joined to the base. The base of each brace is adjacent the rear surface of the third wall of the front face with the first leg parallel to and abutting the side panel of the cabinet and the second leg is parallel to and abutting the flange of the front face. There is provided fastening means for rigidly attaching each of the second legs of the corner braces to the flange of the third wall of the front face and also means to secure a portion of the hot liquid anti-sweat loop to the braces.

DESCRIPTION OF THE PREFERRED EMBODIMENT

Figure 1:
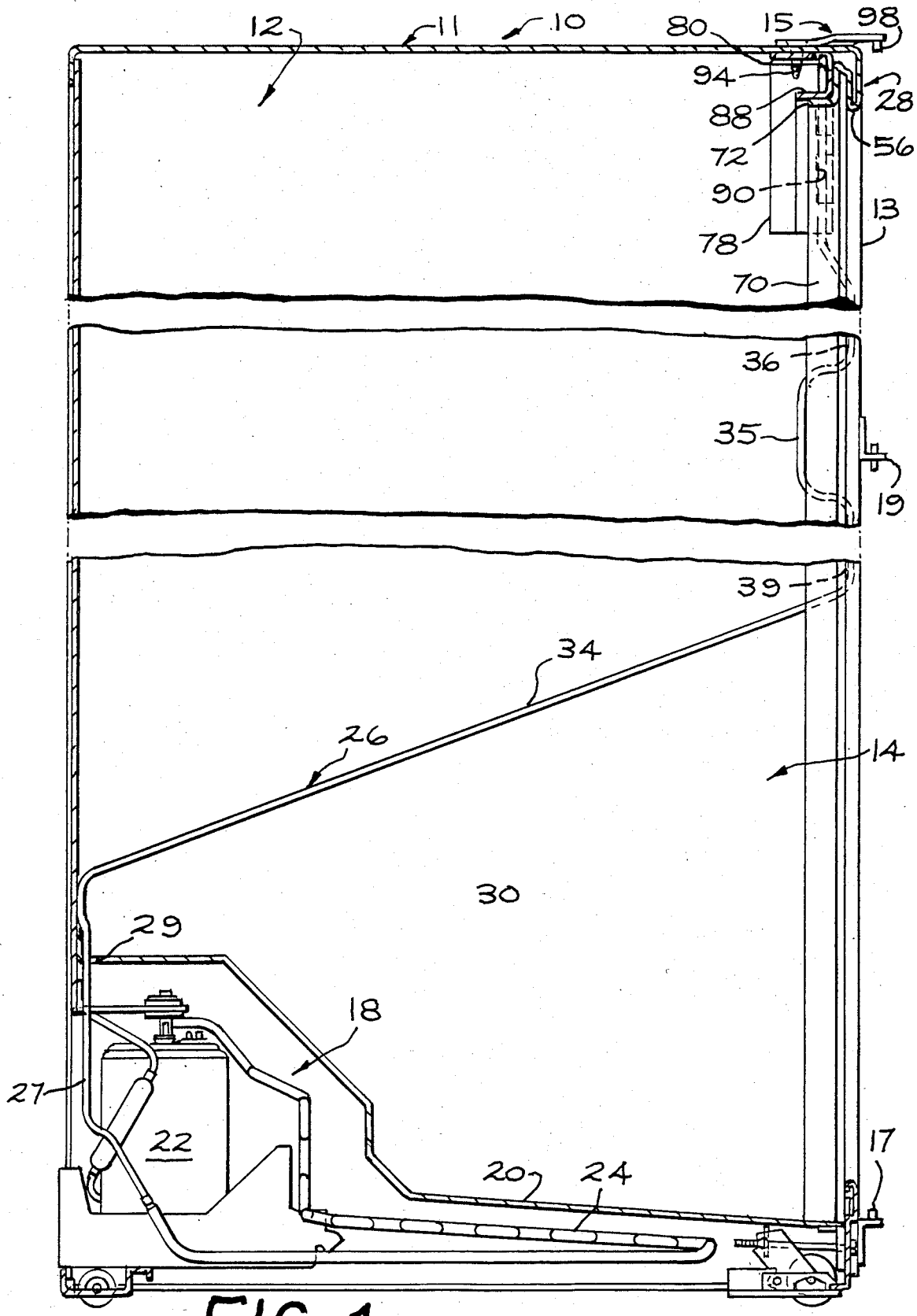
FIG. 1 is a side elevational view in partial cross-section showing a household refrigerator incorporating the present invention.
Figure 3:
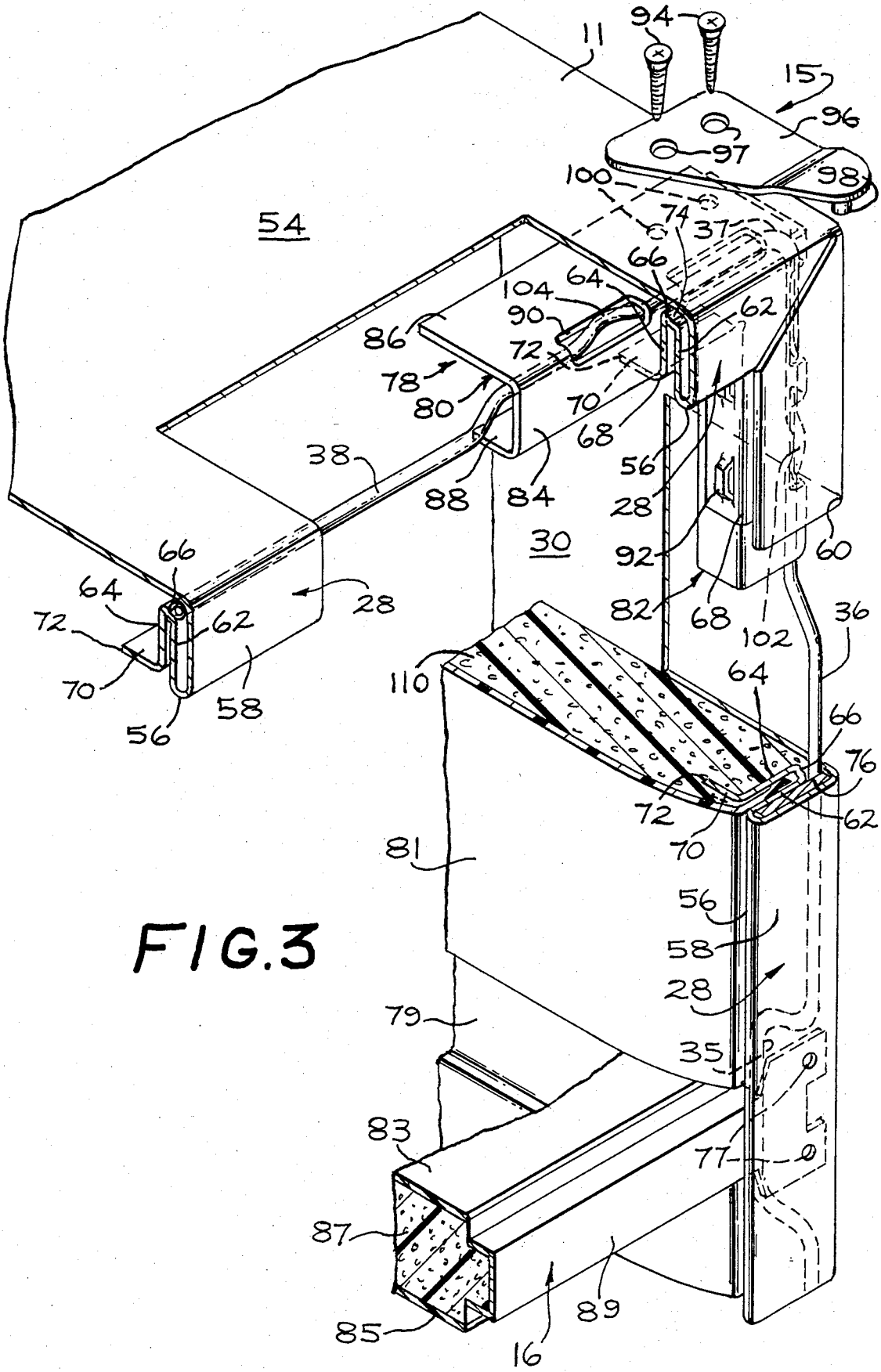
FIG. 3 is a perspective view partly in cross-section showing a portion of the present invention.

With reference to FIG. 1, there is shown a household refrigerator 10 having an outer metal shell 11 with a freezer compartment 12 located at the top of the refrigerator and a fresh food compartment 14 located at the bottom of the refrigerator with the freezer and fresh food compartments separated by a mullion partition 16 (FIG. 3). The freezer compartment access opening 13 is closed by a gasketed door (not shown) hingedly attached to one side of the refrigerator by a top hinge pin assembly 15 and a dual hinge pin assembly 19 secured to the refrigerator in the mullion partition area 16. The fresh food compartment 14 also has a gasketed door (not shown) hingedly attached to one side of the refrigerator by the dual hinge pin assembly 19 at the top and a bottom hinge pin assembly 17. Located below the fresh food compartment 14 is the refrigeration machinery compartment 18 which is separated from the fresh food compartment by a panel 20 which forms the bottom of the fresh food compartment and the top of the machinery compartment. Housed within the machinery compartment 18 is a compressor 22 and a condenser 24 which is in the form of an elongated tube that is bent and formed in a serpentine pattern commonly used in refrigeration systems. The condenser 24 receives hot refrigerant liquid from the compressor 22 which in turn flows through a capillary tube to the evaporator unit (not shown) that is usually housed in back of the freezer compartment and which takes heat from within the refrigerator to boil the refrigerant and then the liquid is passed through a suction line back to the compressor and the cycle continues. There is a hot liquid anti-sweat loop 26 which is used to minimize sweating or condensation around the front face 28 of the freezer compartment 12. The sweating can occur due to normal conduction and/or leakage of cold air from within the freezer compartment which causes the front face 28 to be cold and the warmer humid room ambient air that comes in contact with the cold surface or front face 28 condenses. The hot liquid loop 26 is utilized to warm the front face 28 to prevent the condensation that would normally take place.

Figure 2:
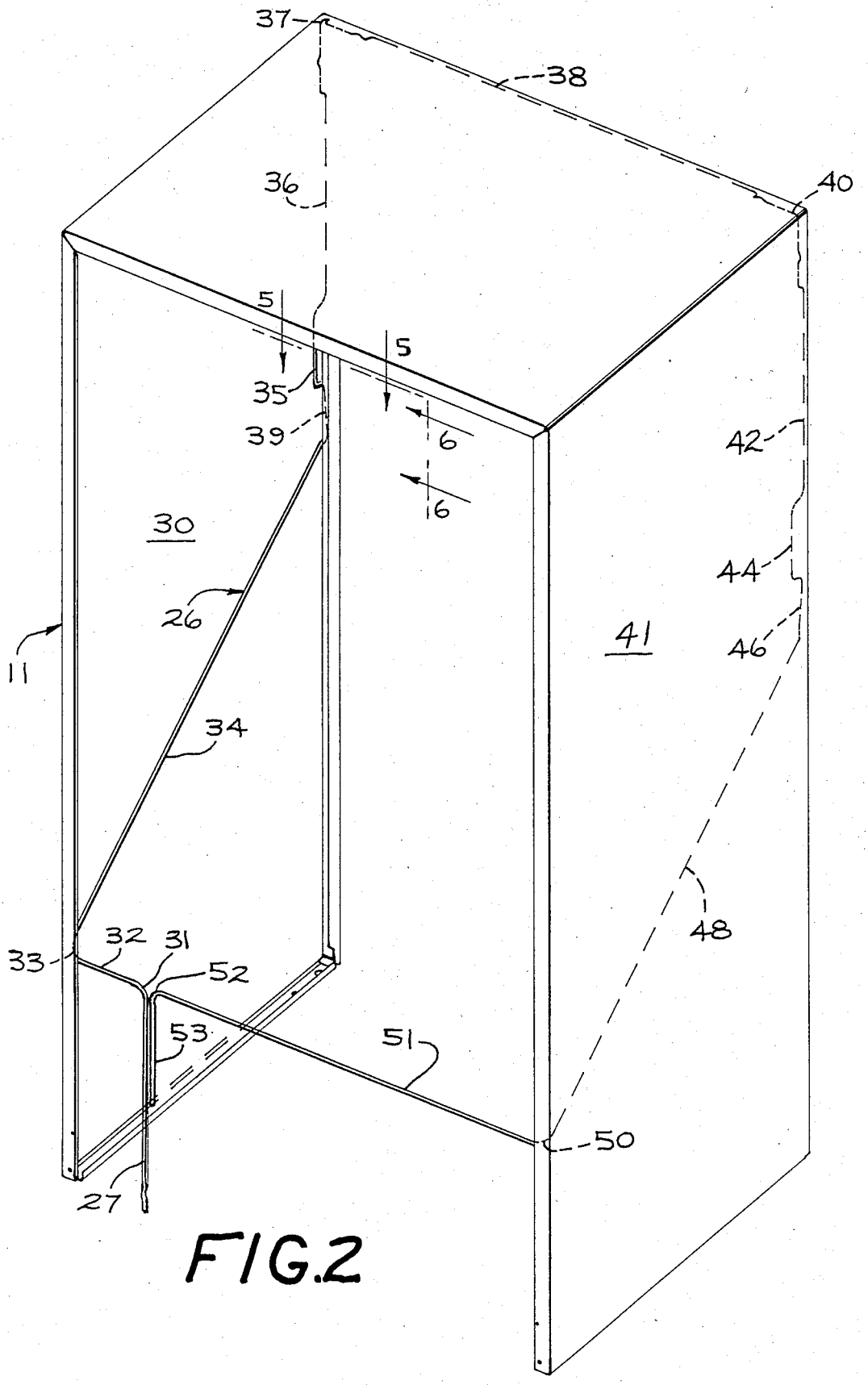
FIG. 2 is a perspective view of the shape of the anti-sweat hot liquid loop utilized in the present invention located in a refrigerator outer metal shell during assembly.

As can be seen particularly in FIGS. 1, 2 and 3, the hot liquid loop 26 exits the machinery compartment 18 at the rear of the compartment through an opening 29. The hot liquid loop 26 has a vertical straight section 27 exiting the machinery compartment 18, then a right angle bend 31 and a straight section 32 that extends over to the side panel 30 of the outer shell 11 where it makes a right angle bend 33. The hot liquid loop 26 has an inclined section 34 between the right angle bend 33 and the front face 28 of the cabinet just below the mullion partition 16 then a short vertical section 39. In the area of mullion partition 16 the loop 26 has an inwardly directed U-shaped bend 35, then a straight section 36 which then reaches a right angle bend 37 which is to fit in one of the top front corners of the refrigerator and then along the top of the refrigerator by straight section 38 to another right angle bend 40 which is to fit in the other top front corner. The hot liquid loop 26 continues down along the opposite side panel 41 of the refrigerator with a straight section 42, then another inwardly directed U-shaped bend 44 in the area of the mullion partition, then a short vertical section 46 and a rearwardly directed straight inclined section 48 which has a reverse bend 50 and a horizontal straight section 51 to a right angle bend 52 and a vertical straight section 53 that passes through hole 29 in the panel 20 at the rear of the machinery compartment 18.

Figure 4:
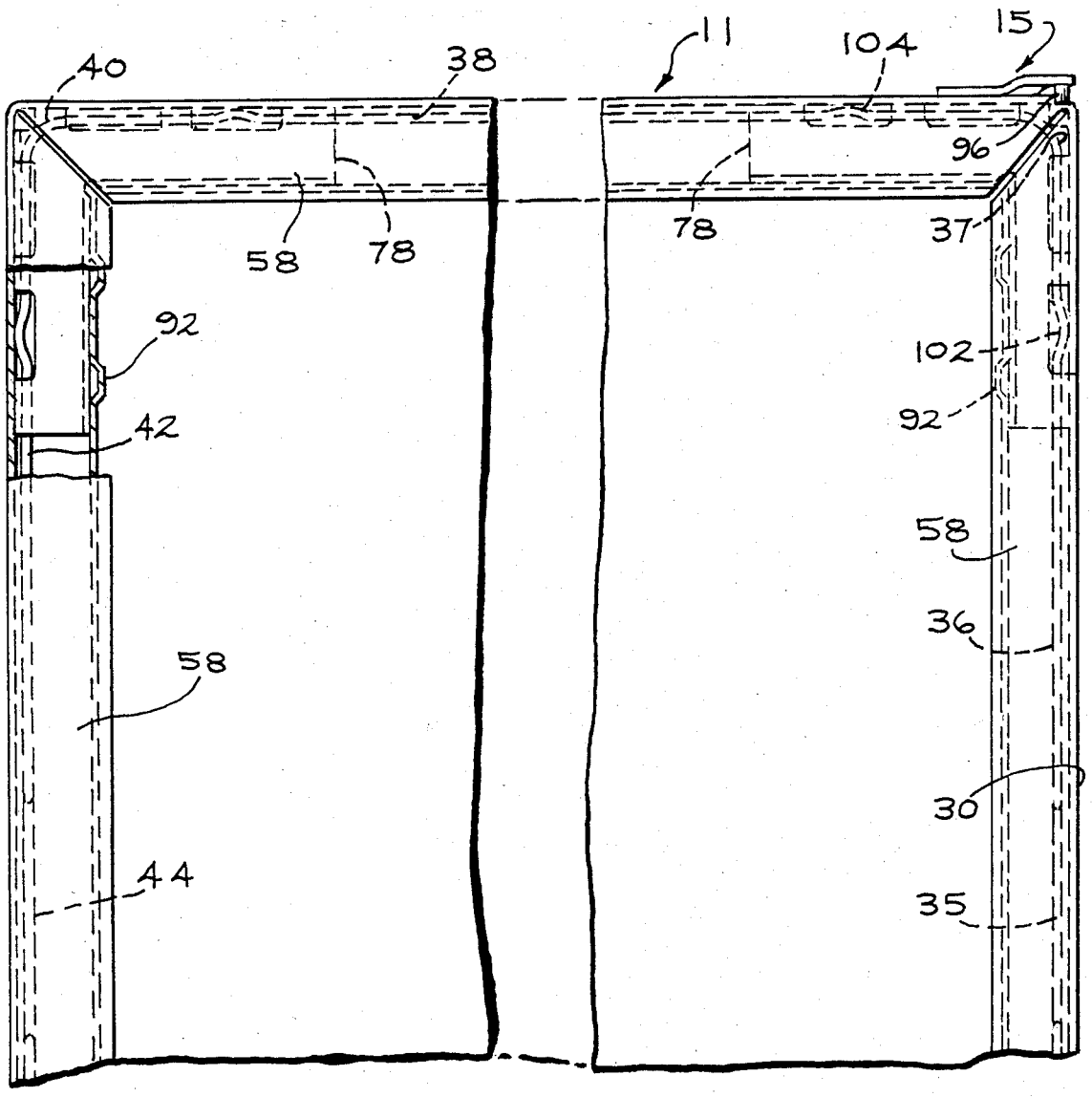
FIG. 4 is a front elevational view of the top portion of a household refrigerator showing a portion of the present invention.

With reference particularly to FIGS. 3 and 4, the top front corner structural arrangement of the refrigerator is shown. The outer metal shell 11 of the refrigerator 10 has a side panel 30 and a front face 28 which extends across the top of the refrigerator and down along the sides of the freezer and fresh food compartments. The front face is formed to provide a first U-shaped portion 56 which includes a first outer wall 58 perpendicular to the side panel 30 to form a corner 60 and a second inner wall 62 spaced from the first outer wall 58. The second inner wall 62 is reversely bent to form a third wall 64 and provide a second U-shaped portion 66 formed between the second inner wall 62 and the third wall 64. The first, second and third walls 58, 62 and 64 respectively are in spaced parallel planes with the third wall 64 bent at a right angle 68 to form a flange 70 with a free terminal edge 72. The second U-shaped portion 66 has formed therein a groove 74 which is dimensioned to receive the hot liquid anti-sweat loop 26.

To provide rigid support for the dual hinge pin 19 that hingedly supports both the freezer access door at the bottom and the top of the fresh food access door there is a metal bar 76 located between the first outer wall 58 and the second inner wall 62. The mullion partition 16 is positioned between the freezer compartment 12 and the fresh food compartment 14 by sliding it in channels 79 formed in the liner 81 on both sides of the refrigerator. The mullion partition 16 has a top surface 83 which is the bottom of the freezer compartment 12 and a bottom surface 85 which is the top of the fresh food compartment 14. Between the surfaces 83 and 85 is sandwiched thermal insulation 87. To rigidly hold the mullion partition in place there is a mullion cross member 89. The metal bar 76 functions as a nut strip that will support screws (not shown) that will pass through holes 77 in the first wall 58 and the mullion cross member 89 for rigidly securing the mullion cross member 89 and the dual hinge pin 19 to the refrigerator cabinet. The inwardly directed U-shaped bends 35 and 44 of the hot liquid loop 26 are so formed to prevent accidentally puncturing the loop 26 when the support screws are driven to secure the mullion cross member 89 and the dual hinge pin 19 to the refrigerator cabinet.

Located at each of the top front corners are braces 78, one of which will be described in detail with particular reference to FIG. 3. The brace is made of metal and has two integrally formed sections 80 and 82 at right angles to each other and each section is formed as an inwardly open U-shaped channel having a base 84, a first leg 86 and a shorter second leg 88 spaced apart and integrally joined to the base 84. The base 84 is located adjacent the rear surface of the third wall 64 of the front face 28 with the first leg 86 of section 80 parallel to and abutting the top wall 54 of the cabinet outer metal shell 11, the first leg 86 of section 82 parallel to and abutting the side panel 30 and the second leg 88 of each brace section 80 and 82 being parallel to and abutting flange 70 of the front face 22. Each of the formed sections 80 and 82 of the brace 78 have cut-out slots 90 at the junction between the base 84 and the first leg 86, the function of which will be described later.

The braces 78 are securely held in place by suitable fastening means such as metal stitching means wherein the two metal parts, namely the second leg 88 of the brace and the flange 70 of the front face 28, are held together by having a section of each upset one within the other to provide an integral fastener formation 92 as is well known in art of fastening two metal panels together. One suitable example of apparatus for such metal fastening means is known in the trade as LANCE-N-LOC or TOG-L-LOC sold by BTM Corporation, Marysville, Mich.

As shown in FIG. 3, secured by screw fasteners 94 is a hinge pin assembly 15 having a hinge pin plate 96 with holes 97 that has at the front end thereof a pivot pin 98. The hinge pin plate 96 and screw fasteners 94 are attached through the top wall 54 of the outer metal shell 11 and engage the rigid brace 78 at holes 100 pre-drilled into the first leg 86 of section 80 of the brace 78.

As can be seen in FIG. 4, the braces 78 are placed one at each of the top front corners of the refrigerator cabinet 11. To position and retain the hot liquid anti-sweat loop 26 in the cabinet, the loop 26 is provided with two curved bump sections 102 and 104 (FIG. 3) at both corners of the loop with the right angle bends 37 and 40 between the two bump sections at each of the top corners of the loop and each bump section has a length slightly less than the length of the cut-out slots 90 in each formed section 80 and 82 of the braces 78.

Figure 5:
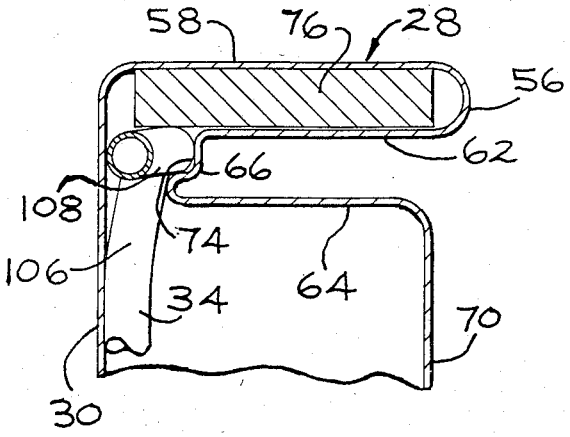
FIG. 5 is a cross-sectional view taken along line 5—5 of FIG. 2.
Figure 7:
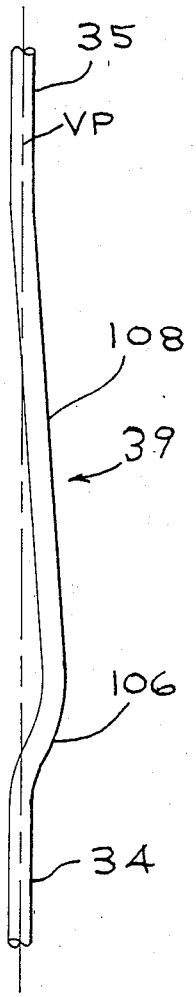
FIG. 7 is a plan view of a portion of the anti-sweat hot liquid loop of the present invention.
Figure 6:
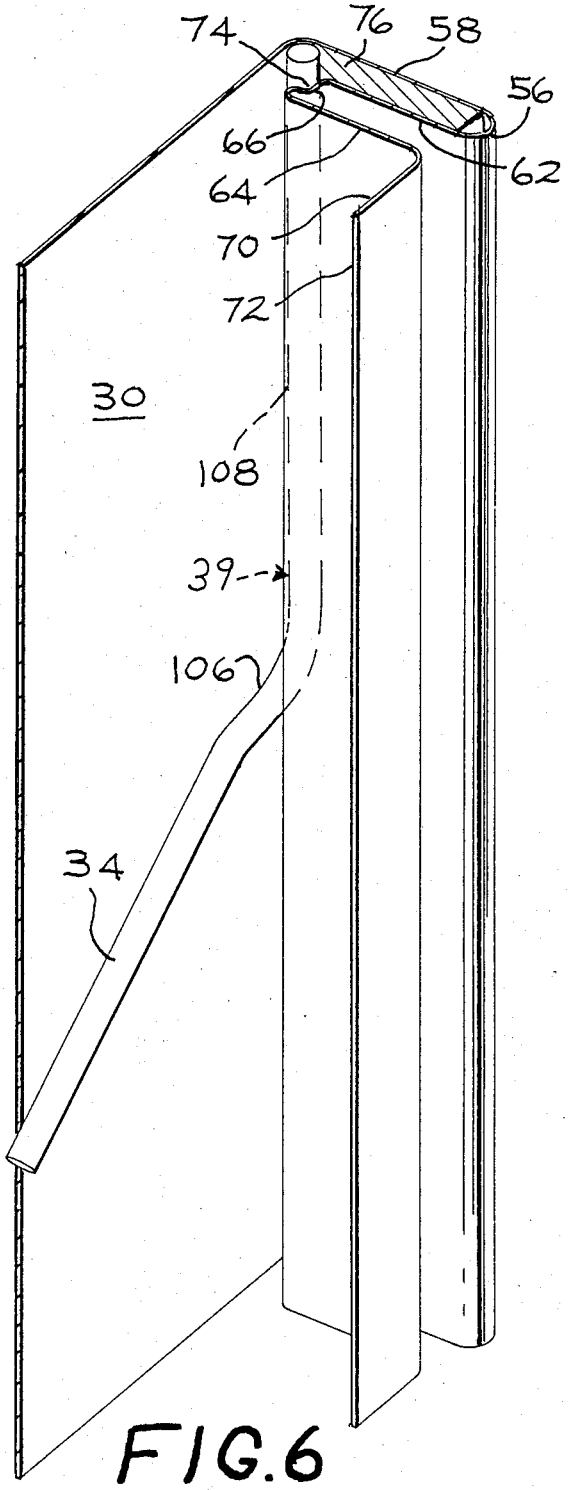
FIG. 6 is a perspective view taken along line 6—6 of FIG. 2.

With reference to FIGS. 2, 5, 6 and 7, the configuration of the short vertical section 39 of the hot liquid anti-sweat loop 26 and its location relative to the front face 28 is shown. Section 39 has a compound curve portion 106 that is bent inwardly relative to straight section 34 and in the direction of the second U-shaped portion 66 then bent outwardly away from the second U-shaped portion 66. Above the compound curve portion 106 is a diverging portion 108 that is inclined toward the side panel 30 and toward the first outer wall 58 and extends from the compound curve portion 106 to just below the U-shaped bend 35. As can be seen in FIG. 7, the compound curve portion 106 and diverging portion 108 depart the central vertical plane, designated VP, of the straight section 34 and U-shaped bend 35. The short vertical section 46 on the other side of the anti-sweat loop 26 is configured the same as short vertical section 39 as described above, but the compound curve section and diverging portion are opposite from that as shown in FIGS. 5, 6 and 7.

The front face 28 has the second U-shaped portion 66 spaced from the side panel 30 a distance slightly greater than the diameter of the hot liquid loop 26 so that it can pass between the U-shaped portion 66 and the side panel 30 as shown in FIG. 6. To install and retain the hot liquid anti-sweat loop 26 in the refrigerator cabinet, the loop as shown in FIG. 2 is placed inside the refrigerator cabinet outer metal shell 11 with the vertical straight sections 27 and 53 passing through the opening 29 in machinery compartment panel 20. The loop is manipulated so that the bump sections 102 and 104 align with the slots 80 in the braces 78 at both corners of the refrigerator cabinet, thus holding the loop in place at the two top front corners as shown particularly in FIGS. 3 and 4. The straight sections 36, 38 and 42 are placed between the groove 74 and the outer metal shell 11 such as side panel 30 and top wall 53 in close proximity to corner 60 as particularly shown in FIG. 3. When this is accomplished, the bump sections 102 and 104 are locked in place in the slots 80. The short vertical sections 39 and 46 are then snapped under the second U-shaped portion 66 by moving straight sections 34 and 48 inward pivoting the compound curve portion 106 outward and under the second U-shaped portion 66 and biased against the front face 28 by the configuration of the vertical sections 39 and 46. When straight sections 34 and 48 are allowed to move outward again toward side panels 30 and 41, the compound curve section 106 is pivoted inward under the second U-shaped portion 66 and is locked in groove 74. The compound curve portion 106 allows for the transition of the liquid loop 26 from under the U-shaped portion 66 through the space between the U-shaped portion 66 and side panels 30 and 41. Straight sections 34 and 48 are at an angle of about 40° relative to the vertical plane VP and that transition bend is also part of the compound curve section 106. The terminal end sections 27 and 53 that pass through the opening 29 in the panel 20 of the machinery compartment 18 are subsequently joined to the rest of the condenser 24 by any suitable joining means. With this arrangement then the hot liquid anti-sweat loop 26 may be installed in the refrigerator cabinet with a minimum amount of clips or other securing means, thus reducing the cost of manufacture and the labor involved in securing the hot liquid loop to the outer metal shell 11. Clips or other securing means may only be needed to keep some of the long sections of the hot liquid loop from bowing away from the corner 60 of the front face 28, which would otherwise detrimentally affect heat transfer from the loop 26 to the front face.

It will be understood that after the above-described cabinet assembly is completed the refrigerator liner 81 (FIG. 3) will be placed inside and spaced from the outer metal shell 11 and the space between the liner 81 and the outer metal shell 11 will be foamed to provide rigid, thermal insulation 110, thus sealing in the hot liquid anti-sweat loop 28 within the cabinet assembly between the liner and outer metal shell. With this configuration and arrangement the hot liquid anti-sweat loop 26 warms the front face 28 in the junction area of the side panels 30 and 41 and top panel 43 around a major portion of the freezer compartment located at the top of the refrigerator.

The foregoing is a description of the preferred embodiment of the invention and it should be understood that variations may be made thereto without departing from the true spirit of the invention as defined in the appended claims.

What is claimed is:

1. A cabinet assembly for a refrigerator having a freezer compartment on top with two top front corners, a fresh food compartment on the bottom, a mullion partition between the compartments and a hot liquid anti-sweat loop comprising:

an outer sheet metal shell having a top panel, side panels and a front face, said front face is formed to provide a first U-shaped portion which includes a first outer wall perpendicular to the side panel to form a corner and a second inner wall spaced from the first outer wall, both walls being connected by the first U-shaped portion, said second inner wall being reversely bent to form a third wall and provide a second U-shaped portion formed between the second inner wall and the third wall, said first, second and third walls being in spaced parallel planes with the third wall bent at a right angle to form a flange having a free terminal edge;

a brace located at each of the two top front corners of the cabinet and having two formed sections at right angles to each other and each section is formed as an inwardly open U-shaped channel having a base, a first leg and a second leg spaced apart and integrally joined to the base, said base being adjacent the rear surface of the third wall of the front face with the first leg parallel to and abutting the side and top panels of the cabinet and the second leg parallel to and abutting the flange of the front face;

fastening means for rigidly attaching each of the second leg of the corner braces to the flange of the third wall of the front face; and means to secure a portion of the hot liquid anti-sweat loop to the braces.

2. The cabinet assembly of claim 1 wherein the fastening means for rigidly attaching each of the second leg of the corner braces to the flange of the third wall of the front face is by metal stitching means.

3. The cabinet assembly of claim 1 wherein the second U-shaped portion of the front face formed between the second inner wall and the third wall is formed to provide a groove to receive the hot liquid anti-sweat loop and hold the loop against the corner of the outer sheet metal shell formed between the first outer wall of the front face and the side panel around a major portion of the freezer compartment.

4. The cabinet assembly of claim 1 wherein each formed section of the braces have cut-out slots and the hot liquid anti-sweat loop has two curved bump sections with a right angle bend between the bump sections and each bump section has a length slightly less than the length of the cut-out slots in each formed section of the braces and the bent curved bump sections are snapped into a cut-out slot in each formed section of the braces to retain the loop in place at the two top front corners of the cabinet.

5. The cabinet assembly of claim 4 wherein the hot liquid loop is formed to have both sides of the loop extend from the bottom rear of the fresh food compartment along the side panels of the outer sheet metal shell to the front face near the top of the fresh food compartment.

6. The cabinet assembly of claim 4 wherein the hot liquid anti-sweat loop has an inwardly directed U-shaped bend on each side of the mullion partition.

7. The cabinet assembly of claim 6 wherein the hot liquid anti-sweat loop has a short vertical section on each side of the refrigerator outer metal shell in close proximity to the U-shaped bends and includes a compound curve portion and a diverging portion inclined toward the side panels and the short vertical section is retained in position under the second U-shaped portion of the front face.

8. A cabinet assembly for a refrigerator having a freezer compartment on top with two top front corners, a fresh food compartment on the bottom, a mullion partition between the compartments and a hot liquid anti-sweat loop comprising:

an outer sheet metal shell having a top panel, side panels and a front face, said front face is formed to provide a first U-shaped portion which includes a first outer wall perpendicular to the side panel to form a corner and a second inner wall spaced from the first outer wall, both walls being connected by the first U-shaped portion, said second inner wall being reversely bent to form a third wall and provide a second U-shaped portion formed between the second inner wall and the third wall, said second U-shaped portion having a groove to receive the hot liquid anti-sweat loop and hold the loop against the corner of the outer sheet metal shell formed between the first outer wall of the front face and the side panel around a major portion of the freezer compartment, said first, second and third walls being in spaced parallel planes with the third wall bent at a right angle to form a flange having a free terminal edge;

a brace located at each of the two top front corners of the cabinet and having two formed sections at right angles to each other and each section is formed as an inwardly open U-shaped channel having a base, a first leg and a second leg spaced apart and integrally joined to the base, said base being adjacent the rear surface of the third wall of the front face with the first leg parallel to and abutting the side and top panels of the cabinet and the second leg parallel to and abutting the flange of the front face, said braces having cut-out slots and the hot liquid anti-sweat loop has two curved bump sections with a right angle bend between the bump sections and each bump section has a length slightly less than the length of the cut-out slots in each formed section of the braces and the bent curved bump sections are snapped into a cut-out slot in each formed section of the braces to retain the loop in place at the two top front corners of the cabinet; and fastening means for rigidly attaching each of the second leg of the corner braces to the flange of the third wall of the front face.

9. The cabinet assembly of claim 8 wherein the hot liquid loop is formed to have both sides of the loop extend from the bottom rear of the fresh food compartment along the side panels of the outer sheet metal shell to the front face near the top of the fresh food compartment.

10. The cabinet assembly of claim 8 wherein the hot liquid anti-sweat loop has an inwardly directed U-shaped bend on each side of the mullion partition.

11. The cabinet assembly of claim 10 wherein the hot liquid anti-sweat loop has a short vertical section on each side of the refrigerator outer metal shell in close proximity to the U-shaped bends and includes a compound curve portion and a diverging portion inclined toward the side panels and the short vertical section is retained in position under the second U-shaped portion of the front face.

* * * * *